US005584686A

United States Patent [19]

Nielsen

[11] Patent Number: 5,584,686

[45] Date of Patent: Dec. 17, 1996

[54] FLEXIBLE AIR SUPPLY CONNECTION IN A GRATE COOLER

[75] Inventor: Sigfred K. Nielsen, Valby, Denmark

[73] Assignee: F. L. Smidth & Co. AS, Denmark

[21] Appl. No.: 428,064

[22] PCT Filed: Nov. 26, 1993

[86] PCT No.: PCT/DK93/00384

§ 371 Date: Apr. 27, 1995

§ 102(e) Date: Apr. 27, 1995

[87] PCT Pub. No.: WO94/12840

PCT Pub. Date: Jun. 9, 1994

[30] Foreign Application Priority Data

Nov. 27, 1992 [DK] Denmark ..... 1421/92

[51] Int. Cl.[6] ..... F27D 15/02

[52] U.S. Cl. ..... 432/77; 110/291

[58] Field of Search ..... 432/77; 110/278, 110/281, 282, 283, 284, 289, 291

[56] References Cited

U.S. PATENT DOCUMENTS 3,751,220 8/1973 Rossi ..... 432/115

FOREIGN PATENT DOCUMENTS

0120227A1 10/1984 European Pat. Off. .
0553878A1 8/1993 European Pat. Off. .
4004393A1 8/1991 Germany .
579748 9/1976 Switzerland .

OTHER PUBLICATIONS

Patent Abstracts of Japan, vol. 3, No. 49, M–57, abstract of JP, A, 54–28015 (Kubota Tekko K.K.), 2 Mar. 1979 (02.Mar.1979).

*Primary Examiner*—Noah P. Kamen
*Attorney, Agent, or Firm*—Brumbaugh, Graves, Donohue & Raymond

[57] ABSTRACT

A flexible connection for supplying cooling air to a movable grate element in a grate cooler. A rigid pipe has two end sections each having a wall thickness exceeding that of the pipe. The end sections are rounded on their outer sides and are each mounted in a displaceable and tiltable manner in separate pipe sockets. One of the sockets is fixed to the movable grate element while the other is fixed to the stationary frame of the cooler.

9 Claims, 1 Drawing Sheet

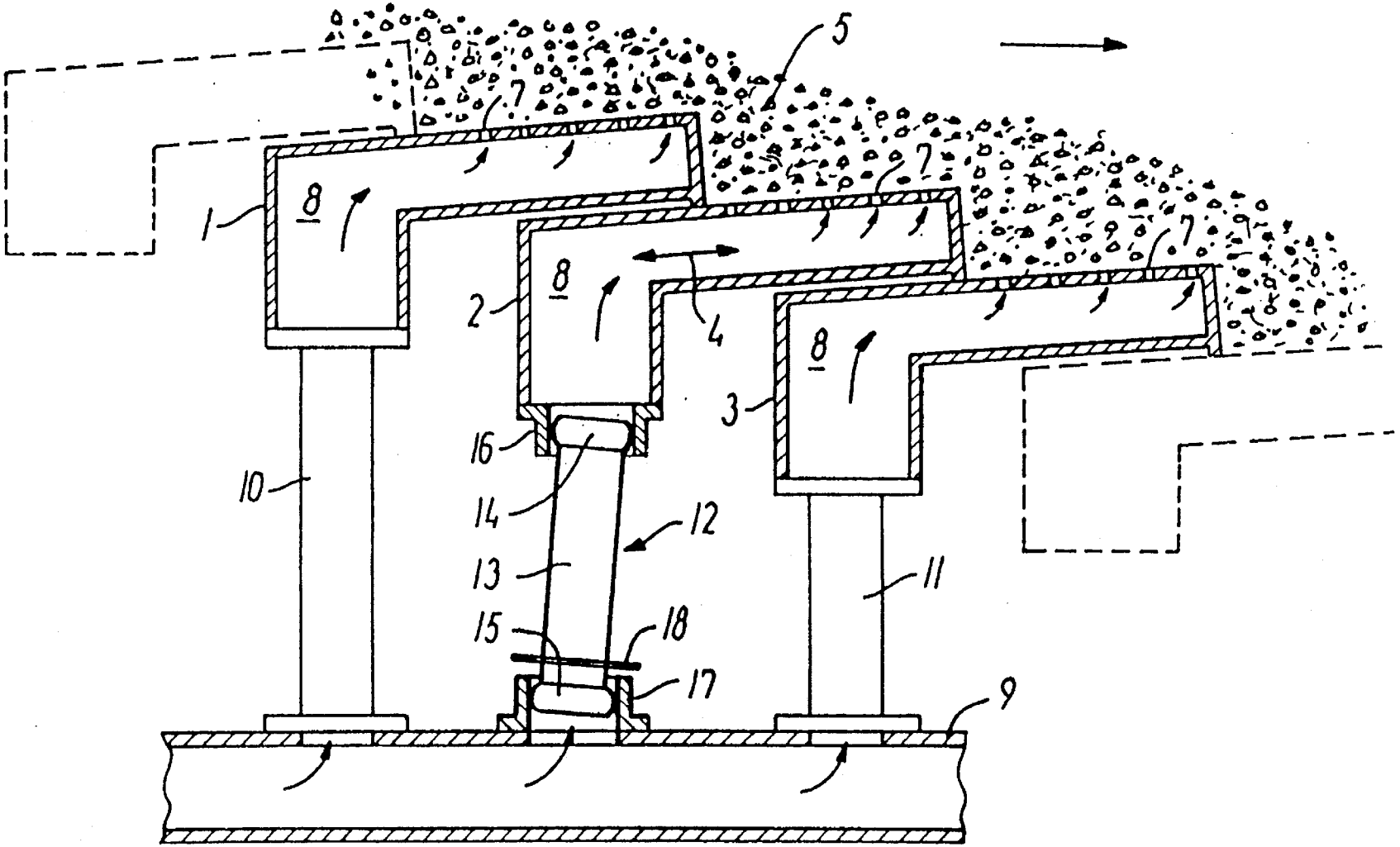
5
7
7
7
8
8
8
4
1
2
3
10
11
9
12
13
14
15
16
17
18

FLEXIBLE AIR SUPPLY CONNECTION IN A GRATE COOLER

BACKGROUND OF THE INVENTION

The present invention relates to a flexible connection for supplying cooling air to a movable grate cooler. The cooler comprises alternate rows of movable stationary grate elements designed for cooling granular material that has been subjected to heat treatment in a kiln, for example a rotary kiln.

When used in connection with a rotary kiln, the grate cooler is mounted at the outlet end of the kiln and is adapted to receive the hot material discharged from the kiln. The material is distributed across the grate surface of the grate cooler and is conveyed in a bed across the grate surface. The material is thereby conveyed through the cooler by the reciprocating movement of the movable grate elements, while the material bed is simultaneously swept by cooling air from the perforated surface of the grate elements.

Grate elements such as described herein are known, for example, from Danish patent application No. 1227/92. Since, generally, the material bed on the grate surface is not homogeneously sized, the cooling air is often separately fed to each single grate element and can thus be controlled for optimum cooling. Consequently, this requires an air supply connection for each of the single grate elements, both the stationary and the movable elements.

Although it is not particularly difficult to supply air to the stationary grate elements, it is an essential requirement that the air connection for the movable grate elements has the required degree of flexibility so that the connection can follow the reciprocating movement of these grate elements.

Therefore, the flexible connection often consists of a flexible hose, such as rubber or canvas or even stainless steel formed as an elastic bellows.

However, such flexible connections are exposed to wear and degradation due to the continuous bending strains. This is further aggravated by exposure to the influence of very hot material which falls down between the grate elements.

BRIEF SUMMARY OF THE INVENTION

The present invention is directed to a flexible connection of the type described above, wherein the aforementioned disadvantages are avoided or substantially reduced. The connection comprises a rigid pipe with two end sections having a wall thickness which exceeds that of the pipe. The pipe sections are rounded on their outer sides and mounted in a displaceable and tiltable manner in separate pipe sockets. The first socket is fixed to the movable grate element while the second is fixed to the stationary frame of the cooler.

Such a flexible connection does not have any parts which are exposed to abrasive and degrading bending strains. Moreover, if at least the end sections are made of wear-resistant material, the service life of the connection can be extended, both with respect to wear resistance and increased resistance to hot falling material.

As additional protection against possible falling, hot material, the stationary pipe socket on the cooler frame may be shielded against such material by means of a collar on the pipe.

BRIEF DESCRIPTION OF THE DRAWING

The invention is described in further detail with reference to the diagrammatical drawing showing a part of a grate cooler in longitudinal section and with a flexible connection according to the invention.

DESCRIPTION OF THE PREFERRED EMBODIMENT

The drawing shows three grate elements 1, 2, 3 which in known manner overlap one another. The center element 2 can be moved to and fro as indicated by means of the double arrow 4. Through the movement of the movable grate element 2, the material 5 to be cooled is conveyed across the grate surface from the left-hand side to the right-hand side on the drawing as indicated by the arrow 6.

During conveyance, the material is swept by cooling air which is blown up through the material via perforations 7 in the surfaces of the grate elements. Under the surface of each grate element is an air chamber 8 which is fed with cooling air from the lower part of the cooler frame 9.

Although it is not particularly difficult to supply the stationary grate elements 1 and 3 with cooling air via rigid connections 10 and 11, the supply of cooling air to the movable grate element 2 requires a flexible connection which can follow the reciprocating movement 4 of this grate element.

The drawing shows an example of such a flexible connection 12. This connection comprises a rigid pipe 13 having two end sections 14 and 15 which can be mounted in a displaceable and tiltable manner in two pipe sockets 16 and 17. The first socket 16 is fixed to the reciprocating grate element 2, whereas the second socket 17 is fixed to the cooler frame 9 which serves as air supply duct. If the rigid pipe 13 has a circular cross section, the end sections will advantageously be configured with a spherical outer side.

The stationary socket 17 may be protected against hot falling material by means of a collar 18 fitted on the pipe 13.

The cross section of the rigid pipe may also be rectangular, preferably square, and in such cases the end sections will not, of course, have a spherical outer side but will also be of rectangular or square configurations. The outer side will have the form of four cylindrical surfaces being perpendicular to one another.

I claim:

1. A grate cooler adapted for the cooling of granular material discharged in a hot state from a kiln by blowing air through the granular material and comprising a stationary frame together with alternate rows of movable and stationary grate elements adapted for supporting a bed of granular material, said elements being provided with air chambers and surface perforations adapted for conveying air from the air chambers through the surfaces of the grate elements into said bed of granular material, said grate cooler comprising at least one flexible air connection for supplying cooling air to a movable grate element, characterized in that the flexible air connection comprises a first pipe socket fixed to the movable grate element, a second pipe socket fixed to the stationary frame and a rigid pipe with two end sections, each of said end sections having a wall thickness exceeding that of the pipe and having a rounded outer side, and each of said end sections being inserted in a respective one of said pipe sockets in a displaceable and tiltable manner.

2. A grate cooler according to claim 1, characterized in that the cross-section of the rigid pipe is circular, and in that the outer sides of the end sections are spherical.

3. A grate cooler according to claim 2, characterized in that the stationary pipe socket on the cooler frame is shielded against down-falling material by means of a collar on the rigid pipe.

4. A grate cooler according to claim 1, characterized in that the cross-section of the rigid pipe is rectangular and in that the outer sides of the end sections have the form of four cylindrical surfaces being perpendicular to one another.

5. A grate cooler according to claim 4, characterized in that the stationary pipe socket on the cooler frame is shielded against down-falling material by means of a collar on the rigid pipe.

6. A grate cooler according to claim 1, 2 or 4, characterized in that the end sections are made of wear-resistant material.

7. A grate cooler according to claim 6, characterized in that the stationary pipe socket on the cooler frame is shielded against down-falling material by means of a collar on the rigid pipe.

8. A grate cooler according to claim 1, characterized in that the stationary pipe socket on the cooler frame is shielded against down-falling material by means of a collar on the rigid pipe.

9. A grate cooler according to claim 8, characterized in that the stationary pipe socket on the cooler frame is shielded against down-falling material by means of a collar on the rigid pipe.

* * * * *